United States Patent [19]

McMahan

[11] 4,452,313

[45] Jun. 5, 1984

[54] CIRCULATION VALVE

[75] Inventor: Michael E. McMahan, Duncan, Okla.

[73] Assignee: Halliburton Company, Duncan, Okla.

[21] Appl. No.: 370,518

[22] Filed: Apr. 21, 1982

[51] Int. Cl.[3] ..... E21B 34/10; E21B 34/12

[52] U.S. Cl. ..... 166/373; 166/317; 166/323; 166/334

[58] Field of Search ..... 166/373, 317, 323, 334; 251/61.2, 344, 63.5

[56] References Cited

U.S. PATENT DOCUMENTS

| | | | |
|---|---|---|---|
| 2,815,930 | 12/1957 | Storm | 175/321 X |
| 3,786,866 | 1/1974 | Tausch et al. | 166/323 X |
| 3,823,773 | 7/1974 | Nutter | 166/0.5 |
| 3,850,250 | 11/1974 | Holden et al. | 166/315 |
| 3,856,085 | 12/1974 | Holden et al. | 166/264 |
| 3,930,540 | 1/1976 | Holden et al. | 166/315 |
| 3,970,147 | 7/1976 | Jessup et al. | 166/250 |
| 3,981,358 | 9/1976 | Watkins et al. | 166/323 |
| 4,044,829 | 8/1977 | Jessup et al. | 166/264 |
| 4,063,593 | 12/1977 | Jessup | 166/317 |
| 4,064,937 | 12/1977 | Barrington | 166/162 |
| 4,077,473 | 3/1978 | Watkins | 166/323 |
| 4,113,012 | 9/1978 | Evans et al. | 166/264 |
| 4,113,018 | 9/1978 | Barrington et al. | 166/334 |
| 4,160,484 | 7/1979 | Watkins | 166/323 X |
| 4,162,691 | 7/1979 | Perkins | 166/323 X |
| 4,270,610 | 6/1981 | Barrington | 166/317 |
| 4,311,197 | 1/1982 | Hushbeck | 166/373 |
| 4,324,293 | 4/1982 | Hushbeck | 166/317 |

*Primary Examiner*—Ernest R. Purser
*Assistant Examiner*—Michael Starinsky
*Attorney, Agent, or Firm*—Lucian Wayne Beavers; James R. Duzan; Thomas R. Weaver

[57] ABSTRACT

A recloseable circulation valve includes a cylindrical housing having a central flow passage disposed therethrough and having a power port and a circulation port disposed through a wall thereof. An operating mandrel is telescopingly received in the upper end of the housing. A valve sleeve is slidably received in the housing and movable to open and close the circulation port. A power mandrel is disposed in the housing and is connected to the valve sleeve for moving the valve sleeve from an initial position toward an open position. A mandrel lock is provided for locking the operating mandrel and power mandrel together after the power mandrel moves the valve sleeve from its initial position. The power mandrel and valve sleeve are initially held in their initial positions by a shear pin assembly. After the power mandrel moves the valve sleeve upward toward its open position, and the power mandrel is locked to the operating mandrel by the mandrel lock, the circulation valve may be subsequently repeatedly opened and closed by picking up weight from or setting down weight on the circulation valve. Methods of testing and treating subsurface formations utilizing such a circulation valve are also disclosed.

12 Claims, 9 Drawing Figures

CIRCULATION VALVE

Figure 1:
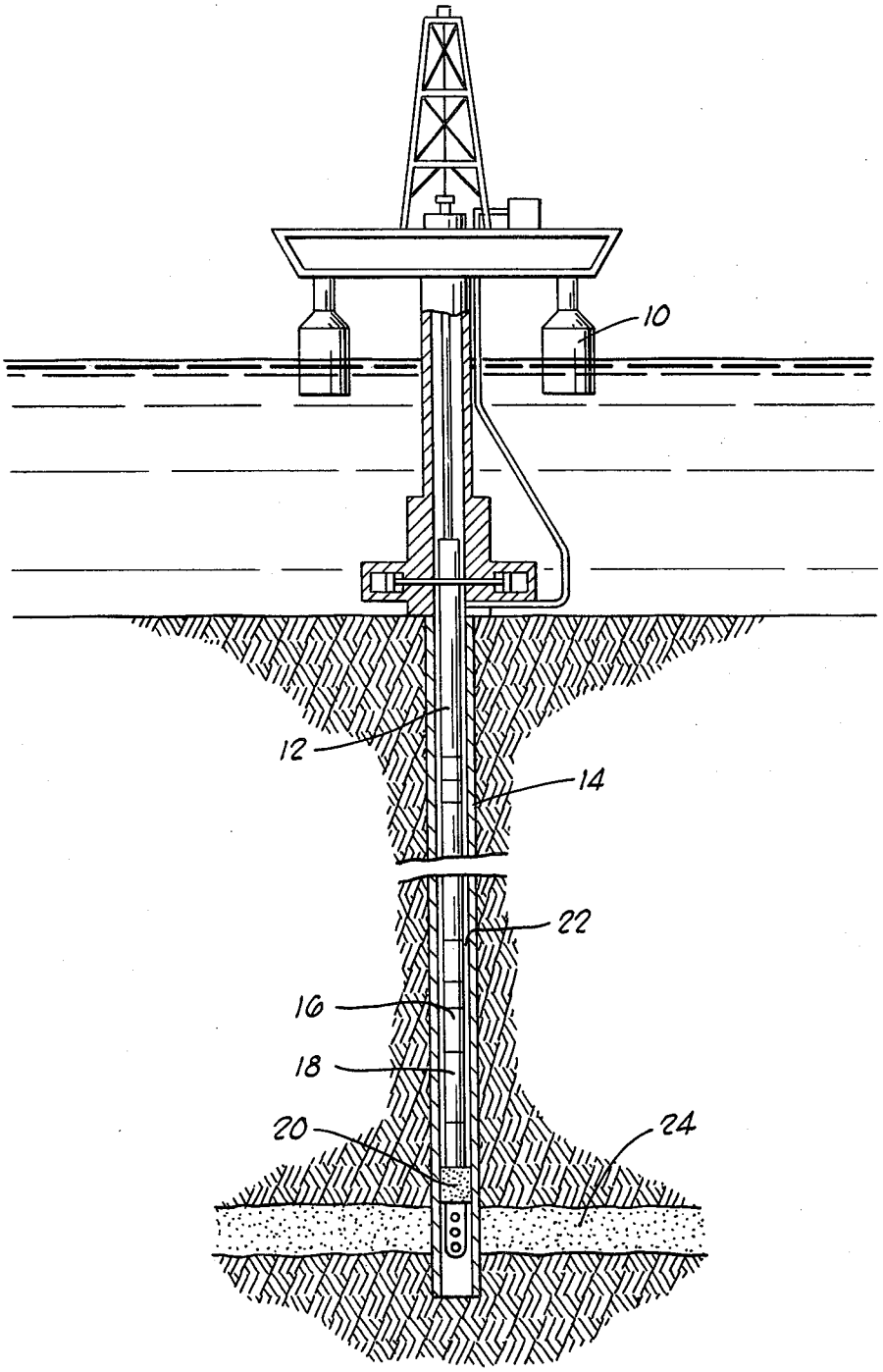

The present invention relates generally to apparatus and methods for testing an oil well, and more particularly, but not by way of limitation, to a reverse circulation valve which operates in response to annulus pressure and which is subsequently recloseable by reciprocation of the test string.

The prior art includes a number of sliding sleeve type circulation valves which are closed in response to annulus pressure. These are shown, for example, in U.S. Pat. No. 3,970,147 to Jessup et al., U.S. Pat. No. 4,044,829 to Jessup et al., U.S. Pat. No. 4,063,593 to Jessup, and U.S. Pat. No. 4,064,937 to Barrington. None of those annulus pressure responsive sliding sleeve circulation valves, however, include any means for reclosing the circulation valve.

Recloseable circulation valves of the prior art typically have included an indexing means which required a number of reciprocating movements to be accomplished by means of repeatedly pressuring up and depressuring a well annulus in order to reclose or reopen a circulation valve. An example of such a recloseable circulation valve is shown in U.S. Pat. No. 4,113,012 to Evans et al.

The present invention provides an improved recloseable circulation valve which may be initially opened by pressurizing the well annulus, and which may subsequently be reclosed and reopened merely by setting down weight on the circulation valve or picking up weight from the circulation valve.

The recloseable circulation valve of the present invention includes a cylindrical housing having a central flow passage disposed therethrough, having a power port disposed through a wall thereof, and having a circulating port disposed through the wall below the power port. An operating mandrel has a lower end telescopingly received in an upper end of the housing, and an upper adapter is attached to an upper end of the operating mandrel for connecting the circulation valve to a test string.

A valve sleeve is slidably received in the housing and movable between an initial position blocking the circulating port and an open position wherein the circulating port is communicated with the central flow passage. A power mandrel has a lower end attached to the valve sleeve and has an upper end within which is telescopingly received the lower end of the operating mandrel. A power piston is disposed on the power mandrel and is sealingly received in an inner cylindrical surface of the housing. The power piston is above the power port and is communicated therewith.

A shear pin assembly is provided for initially retaining the power mandrel in a lowermost position relative to the housing and thereby retaining the valve sleeve in its initial position until a pressure differential across the power piston exceeds a predetermined value.

A mandrel lock is provided for locking the operating mandrel to the power mandrel after the power mandrel moves the valve sleeve from its initial position.

The valve sleeve is moved from its initial position toward an open position by pressurizing the annulus thereby moving the power mandrel with the attached valve sleeve upward. The power mandrel and the operating mandrel are then locked together by the mandrel lock. Subsequently, the circulation valve may be reclosed by setting down weight thereon. It may also be reopened by picking up weight therefrom.

Numerous objects, features and advantages of the present invention will be readily apparent to those skilled in the art upon a reading of the following disclosure when taken in conjunction with the accompanying drawings.

FIG. 1 is a schematic elevation view of a well test string, utilizing the circulation valve of the present invention in place within a subsea oil well.

FIGS. 2A–2D comprise an elevation right side only section view of the circulation valve of the present invention, showing the valve sleeve in its initial position, and showing the operating mandrel in a telescopingly extended position relative to the housing.

FIGS. 3A–3D comprise an elevation right side only section view of the circulation valve of the present invention, showing the power mandrel and the valve sleeve moved upward to an uppermost position wherein the power mandrel is locked to the operating mandrel. The operating mandrel is still shown in its telescopingly extended position.

During the course of drilling an oil well, the borehole is filled with a fluid known as drilling fluid or drilling mud. One of the purposes of this drilling fluid is to maintain in intersected formations, any formation fluid which may be found therein. To contain these formation fluids, the drilling mud is weighted with various additives so that the hydrostatic pressure of the mud at the formation depth is sufficient to maintain the formation fluid within the formation without allowing it to escape into the borehole.

When it is desired to test the production capabilities of the formation, a testing string is lowered into the borehole to the formation depth, and the formation fluid is allowed to flow into the string in a controlled testing program. Lower pressure is maintained in the interior of the testing string as it is lowered into the borehole. This is usually done by keeping a formation tester valve in the closed position near the lower end of the testing string. When the testing depth is reached, a packer is set to seal the borehole thus closing in the formation from the hydrostatic pressure of the drilling fluid in the well annulus.

The tester valve at the lower end of the testing string is then opened and the formation fluid, free from the restraining pressure of the drilling fluid, can flow into the interior of the testing string.

The testing program includes periods of formation flow and periods when the formation is closed in. Pressure recordings are taken througout the program for later analysis to determine the production capability of the formation. If desired, a sample of the formation fluid may be caught in a suitable sample chamber.

With the nonrecloseable circulation valves typically used in the prior art, the circulation valve is opened at the end of the testing program, and formation fluid in the testing string is circulated out. Then the packer is released and the testing string is withdrawn.

If a recloseable circulation valve is provided, the circulation valve may be reclosed after the formation fluid is circulated out of the testing string, and then subsequent operations may be performed on the well, such as acid treating operations on the subsurface formation, without pulling the testing string from the well.

The present invention particularly relates to improvements in recloseable circulation valves for use in a testing string as just described.

Referring now to FIG. 1, a typical arrangement for conducting a drill stem test offshore is shown. The general arrangement of such a well test string is known in the art and is shown, for example, in U.S. Pat. No. 4,064,937 to Barrington, the details of which are incorporated herein by reference.

Of particular significance to the present invention, FIG. 1 shows a floating work station 10 from which a well test string 12, which may also be referred to as a pipe string, is suspended into a subsea well defined by a well casing 14. Near the lower end of the test string 12, there is located therein a recloseable circulation valve 16 of the present invention. Below the circulation valve 16 is located a conventional annulus pressure responsive tester valve 18 which may be constructed in a fashion like that of U.S. Pat. No. 3,856,085 to Holden et al. Below the circulation valve 18, there is a conventional packer 20 for sealing an annulus 22 between the well test string 12 and the well casing 14 above an underground formation 24 which is to be tested.

Referring now to FIGS. 2A–2D, an elevation right side only section view is there shown of the recloseable circulation valve 16. The valve 16 includes a cylindrical housing 26 having a central flow passage 28 disposed therethrough, and having a power port 30 disposed through a wall thereof, and a circulating port 32 disposed through a wall thereof below the power port 30.

An operating mandrel means 34 includes an operating mandrel 36 having a lower end 38 telescopingly received within an upper end 40 of housing 26.

Operating mandrel means 34 also includes an upper adapter 42 attached to an upper end of operating mandrel 36 at threaded connection 44. Upper adapter 42 includes internal threads 46 for connection of the circulation valve 16 within the test string 12.

Figure 2A:
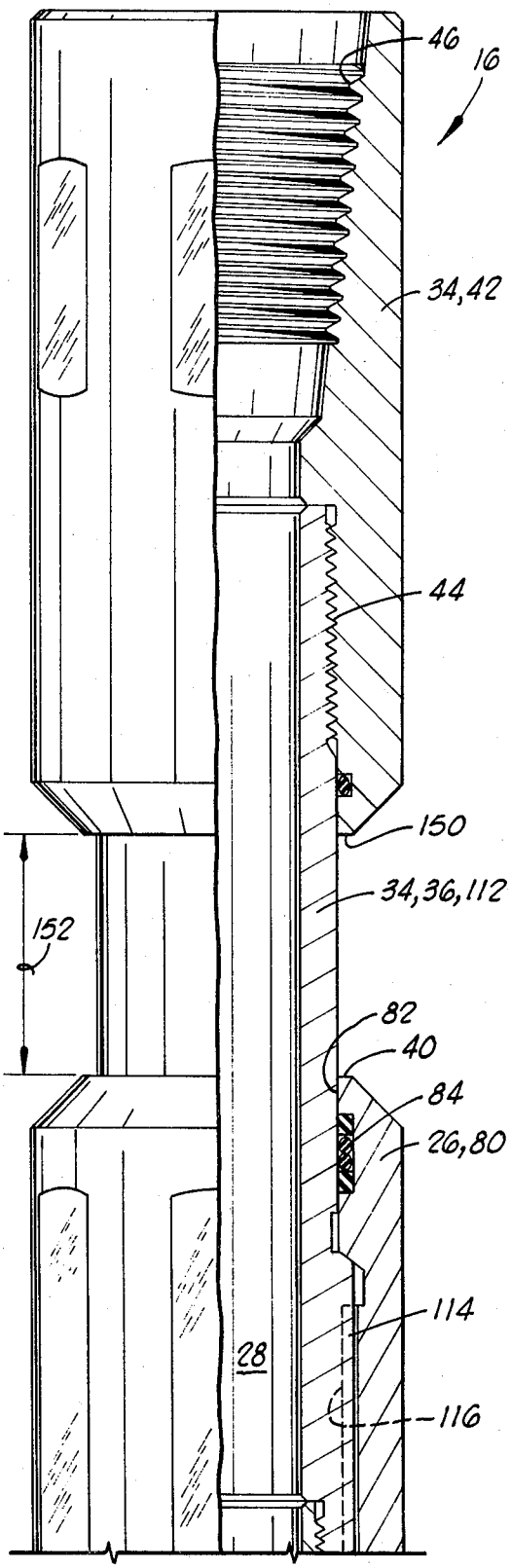
Figure 2B:
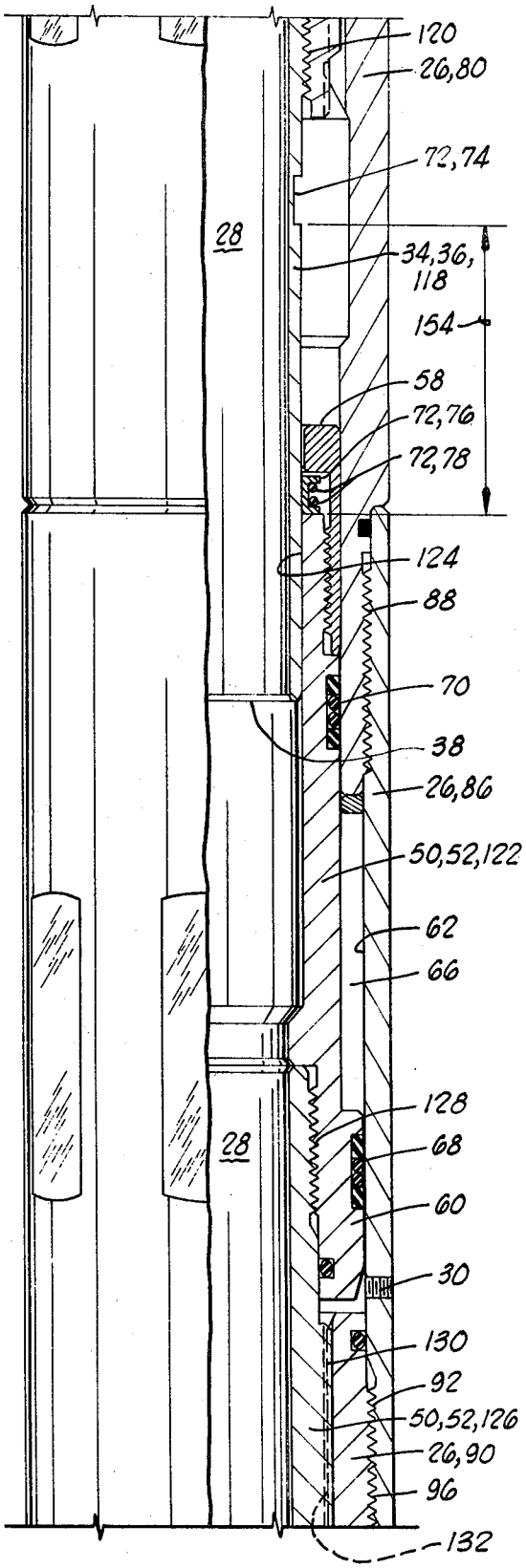
Figure 2C:
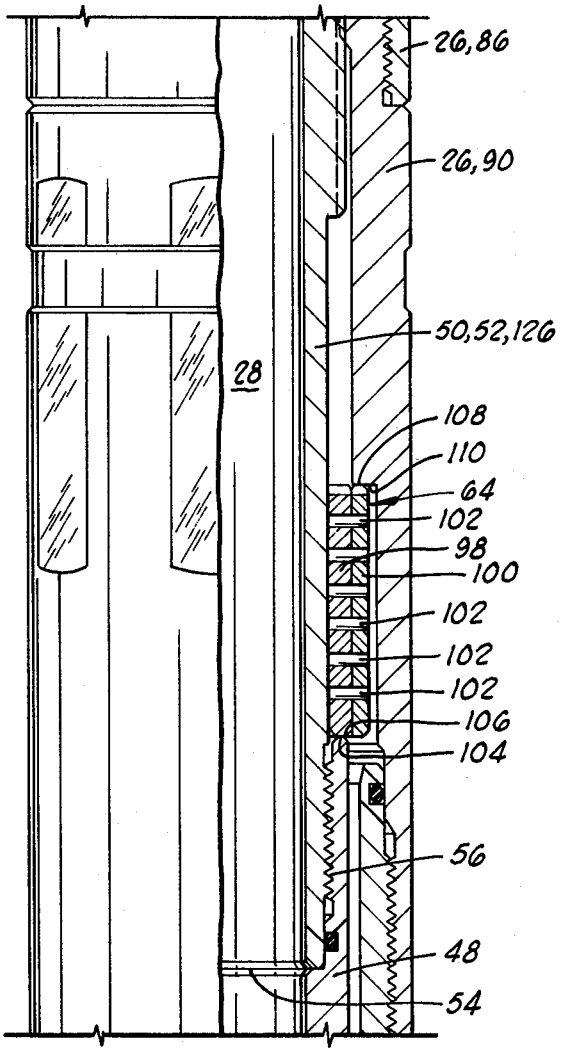
Figure 2D:
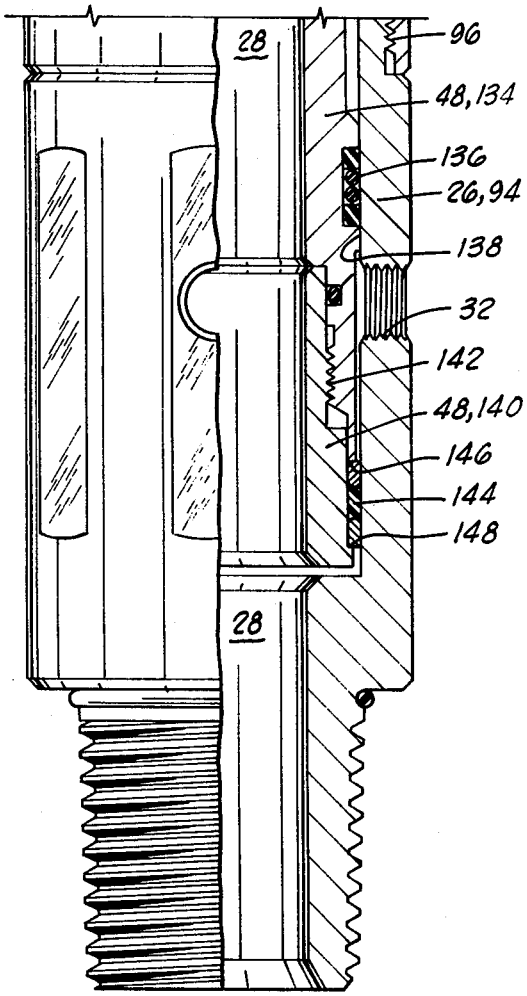
Figure 3A:
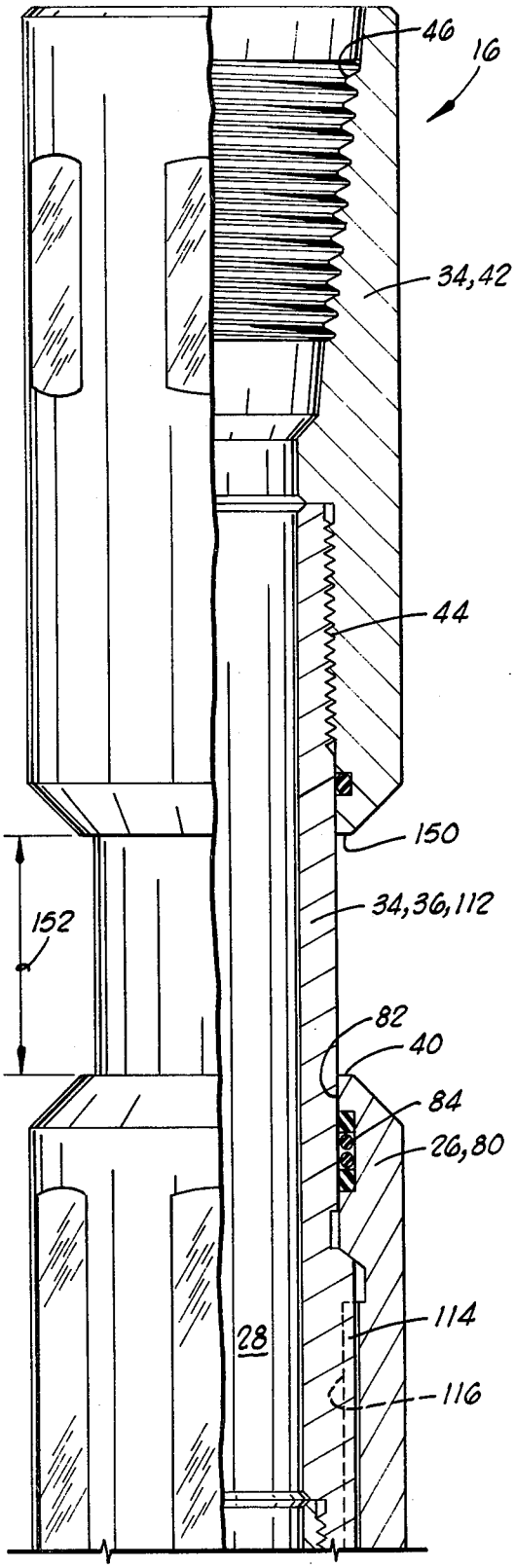
Figure 3B:
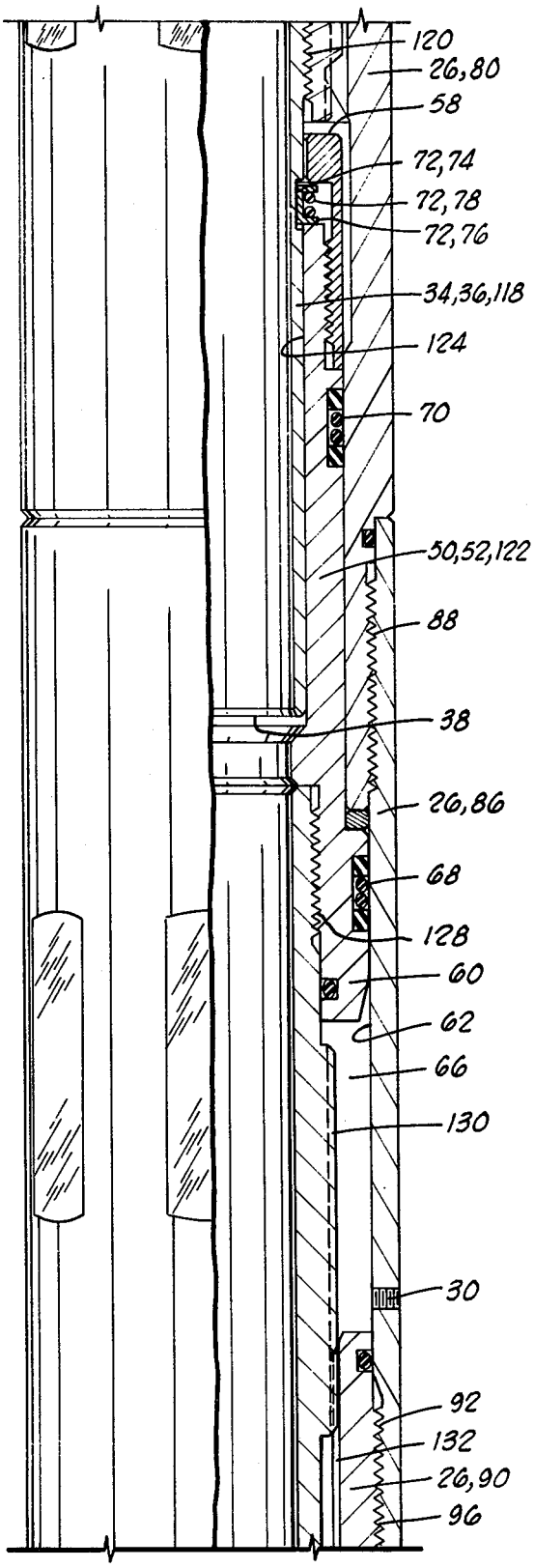
Figure 3C:
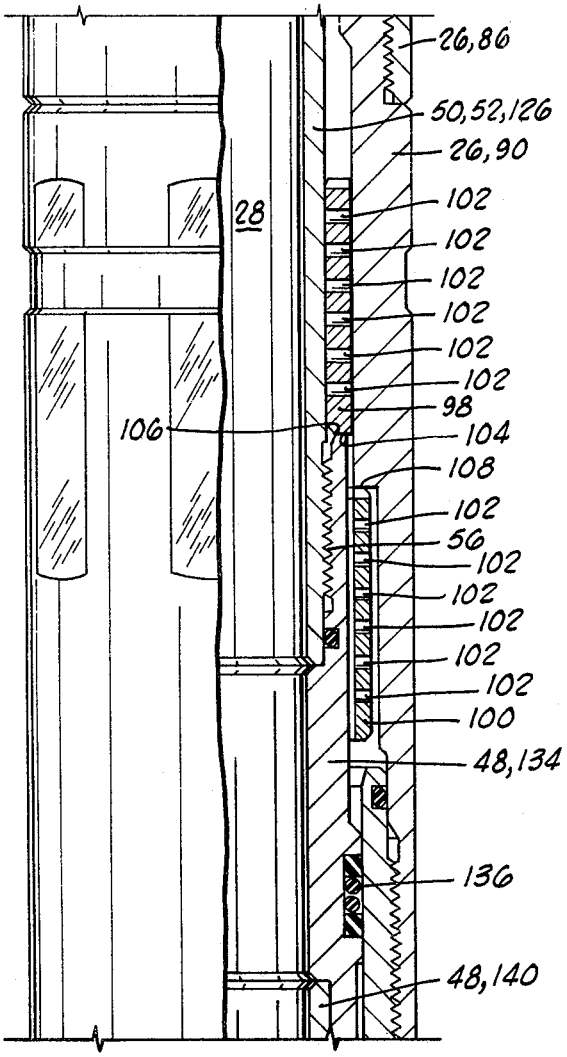
Figure 3D:
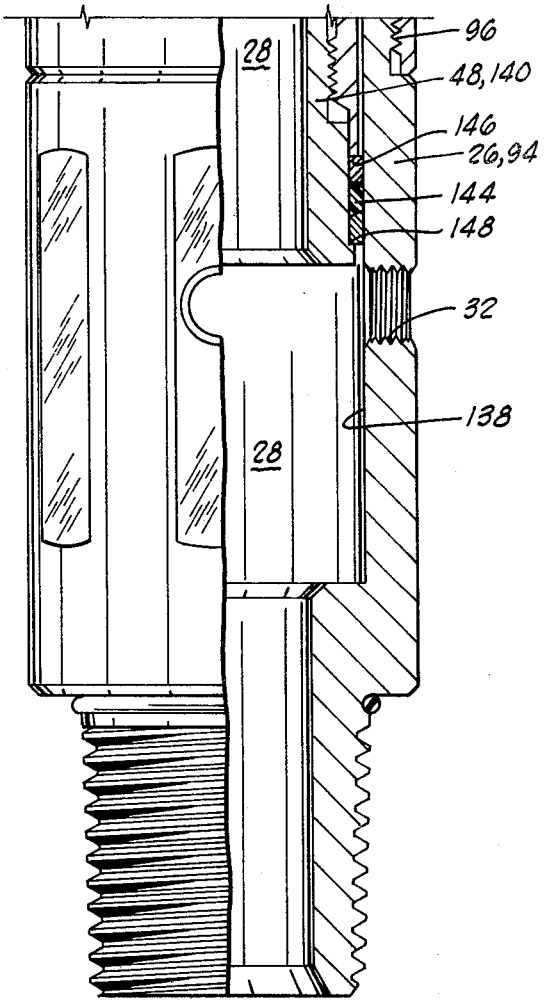

A valve sleeve 48 is slidably received within the housing 16 and movable between an initial position illustrated in FIGS. 2C–2D blocking the circulating port 32 and an open position illustrated in FIGS. 3C–3D wherein circulating port 32 is communicated with the central flow passage 28.

A power mandrel means 50 includes a power mandrel 52 having a lower end 54 threadedly connected to valve sleeve 48 at threaded connection 56.

Power mandrel means 52 has an upper end 58 within which is telescopingly received the lower end 38 of operating mandrel 36.

A power piston 60 is disposed on power mandrel 52 and sealingly received by a cylindrical surface 62 of housing 34.

The power piston 60 is located above power port 30 so that the lower side of power piston 60 is communicated with power port 30.

A shear pin assembly 64, which may also be referred to as a frangible retaining means 64 or a releasable retaining means 64, is operably associated with power mandrel 52, the valve sleeve 48, and the housing 16 for initially retaining the power mandrel 52 in its lowermost position as illustrated in FIGS. 2B–2C relative to the housing 26, thereby retaining the valve sleeve 48 in its initial position illustrated in FIGS. 2C–2D until a pressure differential across the power piston 60 exceeds a predetermined value determined by the construction of the shear pin assembly 64.

The upper side of the power piston 60 is communicated with a sealed chamber 66 which is either empty or filled with a gas and is at substantially atmospheric pressure. The power piston 60 may also be referred to as a differential area piston means, wherein the differential area is determined between an outer seal 68 between the power piston 60 and the inner cylindrical surface 62 and an inner seal 70 between the power mandrel 52 and the housing 26.

A mandrel locking means 72 comprising a groove 74 disposed in an outer cylindrical surface of operating mandrel 36, dog means 76 carried by power mandrel 52, and resilient O-ring biasing means 78 engaging the dog means 76, is provided for locking the operating mandrel 36 to the power mandrel 52 after the power mandrel 52 moves the valve sleeve 48 from its initial position, in a manner further described below.

The housing 26 includes a latch housing 80 which defines the upper end 40 of the housing 26 and which has the operating mandrel 36 closely and slidingly received within a bore 82 thereof. Annular seal means 84 are disposed between the operating mandrel 36 and the bore 82 of latch housing 80.

A differential housing 86 has an upper end threadedly connected to a lower end of latch housing 80 at threaded connection 88. The inner cylindrical surface 62 of housing 26 is an inner cylindrical surface of differential housing 86. The power port 30 is disposed through a wall of differential housing 86.

An intermediate adapter 90 has an upper end threadedly connected to a lower end of differential housing 86 at threaded connection 92.

A lower adapter 94 has an upper end threadedly connected to a lower end of intermediate adapter 90 at threaded connection 96. Circulation port 32 is disposed through a wall of lower adapter 94.

The housing 26 is made up of the latch housing 80, differential housing 86, intermediate adapter 90 and lower adapter 94.

The shear pin assembly 64 includes a pair of concentric sleeves including an innermost sleeve 98 and an outermost sleeve 100. Sleeves 98 and 100 are connected together by a plurality of radially oriented shear pins 102 arranged to be sheared upon relative longitudinal movement between concentric sleeves 98 and 100.

A lower end 104 of inner sleeve 98 abuts an upper end 106 of valve sleeve 48.

An upper end 108 of outer sleeve 100 abuts a downward facing shoulder 110 of intermediate adapter 90 of housing 26.

Operating mandrel 36 includes an upper operating mandrel portion 112 which is attached to upper adapter 42. Upper operating mandrel portion 112 includes radially outward extending longitudinal spline means 114 engaging a radially inward extending longitudinal spline means 116 of latch housing 80 to prevent relative rotational movement between operating mandrel 36 and housing 26.

Operating mandrel 36 further includes a lower operating mandrel portion 118 having an upper end threadedly connected to a lower end of upper operating mandrel portion 112 at threaded connection 120.

The power mandrel 52 includes an upper power mandrel portion 122 having the power piston 60 integrally formed on a lower end thereof. The lower end 38 of lower operating mandrel portion 118 is closely received within a bore 124 of upper power mandrel portion 122.

Power mandrel 52 further includes a lower power mandrel portion 126 having an upper end threadedly connected to a lower end of upper power mandrel portion 122 at threaded connection 128.

It is the lower end 54 of lower power mandrel portion 126 which is threadedly connected to valve sleeve 48 at threaded connection 56.

Lower power mandrel portion 126 includes a radially outward extending longitudinal spline means 130 engaging a radially inward extending longitudinal spline means 132 of intermediate adapter 90.

The valve sleeve 48 includes an upper valve sleeve portion 134 which is the part of valve sleeve 48 which is threadedly connected to lower power mandrel portion 126 at threaded connection 56.

An annular upper valve seal means 136 is disposed in a radially outer surface of upper valve sleeve portion 134 and sealingly engages a bore 138 of lower adapter 94 above circulation port 32.

Valve sleeve 48 further includes a lower valve sleeve portion 140 which is threadedly connected to a lower end of upper valve sleeve portion 134 at threaded connection 142.

An annular lower valve seal means 144 is trapped between a downward facing shoulder 146 defined on the lower end of upper valve sleeve portion 134 and an upward facing shoulder 148 of lower valve sleeve portion 140. Lower valve seal means 144 sealingly engages bore 138 of lower adapter 94 below circulation port 32 when the valve sleeve 48 is in its initial or closed position, and is located above circulation valve 32 when the valve sleeve 48 is in its open position as shown in FIG. 3D. The lower valve seal 144 is tapered and locked within a tapered groove so that it will not be blown out as it passes the circulation port 32.

When the circulation valve 16 is first lowered into a well 14 with the test string 12, the circulation valve 16 is generally oriented as shown in FIGS. 2A–2D. The valve sleeve 48 and the power mandrel means 50 are initially retained in the positions illustrated in FIGS. 2B–2D by the shear pin assembly 64.

So long as there is tension longitudinally placed across the circulation valve 16, the operating mandrel 36 is in its telescopingly extended position relative to the housing 26 as illustrated in FIGS. 2A–2B. A telescopingly collapsed position (not shown) of the operating mandrel 36 relative to the housing 26 may be achieved by placing longitudinal compression across circulation valve 16 so that operating mandrel 36 moves downward relative to housing 26 until a lower shoulder 150 of upper adapter 42 engages upper end 40 of housing 26.

A longitudinal travel distance 152 is defined by the distance traversed by operating mandrel 36 as it moves from its telescopingly extended position to its telescopingly collapsed position.

Even while the power mandrel 52 and valve sleeve 48 are still initially pinned in their initial positions, the operating mandrel 36 is free to telescopically move within the housing 26 between its telescopingly extended position and telescopingly collapsed position.

A locking distance 154 is the distance between the groove 74 and the dog means 78 of mandrel locking means 72 which must be traversed by relative longitudinal movement between operating mandrel 36 and power mandrel 52 in order for the dog means 76 to be aligned with groove 74 so that the operating mandrel 36 and power mandrel 52 may be locked together.

The locking distance 154 is greater than the travel distance 152, so that so long as the power mandrel 52 and valve sleeve 48 are retained in their initial positions by shear pin assembly 64, the groove 74 cannot be moved low enough to engage the dog means 78 even when the operating mandrel 36 is telescopingly collapsed relative to housing 26.

When the pressure in annulus 22 is increased to a predetermined value sufficient to shear the shear pins 102, the power mandrel 52 and valve sleeve 48 are moved upward within housing 26 until the dog means 76 is aligned with groove 74 and moved into groove 74 by biasing means 78 to lock the operating mandrel 36 to the power mandrel 52.

If the operating mandrel 36 is in its telescopingly extended position when the power mandrel 52 so moves the valve sleeve 48 upwards, then the valve sleeve 48 will be moved to its completely open position as shown in FIGS. 3C–3D at which time the dog means 78 will be aligned with the groove 74.

If, however, the operating mandrel 36 is in its telescopingly collapsed position or is in a partially collapsed position, then the power mandrel means 52 will move upward until the dog means 76 is aligned with the groove 74 and becomes locked therein. At that time, further upward movement of the valve sleeve 48 must generally be accomplished by picking up weight from the circulation valve 16 unless the pressure within annulus 22 is sufficiently great so as to lift a portion of the weight of the test string 12 as the operating mandrel 36 is extended.

After the operating mandrel 36 and the power mandrel 52 are locked together, the circulation valve 16 may be closed by setting down weight thereon and moving operating mandrel 36 to its telescopingly collapsed position wherein the circulation valve 48 is moved downward to a closed position closing the circulation port 32.

It is noted that when the operating mandrel 36 is locked to the power mandrel 52 by locking means 72 and when the operating mandrel 36 is then moved downward to its telescopingly collapsed position so as to move the valve sleeve 48 to a closed position, the valve sleeve 48 is still displaced upward relative to its initial position illustrated in FIG. 2D, by a distance equal to the difference between the travel distance 152 and the locking distance 154.

Referring once again to FIG. 1, the general manner of flow testing a well utilizing a test string 12 having the circulation valve 16 of the present invention included therein is as follows.

First, the test string 12 is provided with the circulation valve 16, a tester valve 18 below the circulation valve 16, and a packer means 20 below the tester valve 18. The tester valve 18 and circulation valve 16 are each initially in a closed position.

Then the test string 12 is lowered into the well 14 to a desired depth wherein the packer means 20 is located above the subsurface formation 24 which is to be tested.

Then weight is set down on the packer means 20 to set the packer to seal the annulus 22 between the test string 12 and the well 14.

Then the annulus 22 is pressurized to a first predetermined level to thereby open the tester valve 18 and allow a formation fluid from the subsurface formation 24 to flow upward through an interior of the test string 12.

This first predetermined level is less than the annulus pressure necessary to open the circulation valve 16, so the circulation valve 16 remains closed. With the circulation valve 16 closed and the tester valve 18 open, the flow testing is performed. There may be periods of open-flow testing and periods of shut-in testing which are accomplished by repeatedly opening and closing the tester valve 18 by varying the pressure in annulus 22. During the flow testing operation, however, the pressure in annulus 22 remains below the level required to open the circulation valve 16.

At the end of the flow testing operation, the pressure within annulus 22 is raised to a second predetermined level above the first predetermined level thereby moving the differential area piston means 60 of the circulation valve 16 and thereby opening the circulation valve 16 to communicate the interior of the test string, a portion of which is formed by central flow passage 28, with the annulus 22 above the packer means 20. This eliminates the differential pressure between the annulus 22 and the interior of the test string 12 which initially opened the tester valve 18, thus allowing the tester valve 18 to close as the circulation valve 16 is opened.

Then formation fluid is circulated upward out of the test string 12 by pumping drilling fluid down the annulus 22, then through the circulation valve 16 and up the interior of the test string 12.

In a typical prior art system utilizing a nonrecloseable circulation valve, that would be the end of the testing program, and it would then be necessary to pull the test string 12 from the well 14.

With a recloseable circulation valve, the circulation valve may be reclosed and other operations may be performed.

With the recloseable circulation valve 16 of the present invention, the valve 16 may be reclosed merely by setting down weight on the circulation valve 16 with the test string 12 to thereby telescopingly collapse the operating mandrel 36 relative to the housing 26. The operating mandrel 36 and housing 26 may be referred to as two telescopingly engaged tubular members of the circulation valve 16.

After the flow testing is completed, it is possible, with a recloseable circulation valve, to perform further treating operations on the subsurface formation 24 without pulling the test string 12 from the well 14.

This may be accomplished with the present invention by maintaining the circulation valve 16 closed by maintaining weight set down thereon, and while the circulation valve 16 is closed, repressurizing the annulus 22 to said first predetermined pressure level to thereby reopen the tester valve 18, and then pumping a treating fluid, such as acid, down the interior of the test string 12 and into the subsurface formation 24.

It is noted that when the pressure within the annulus 22 is first raised to the second predetermined level to open the circulation valve 16, the operating mandrel 36 may be in either its telescopingly extended position, or its telescopingly collapsed position, or somewhere therebetween.

Preferably, prior to opening the circulation valve 16, the operating mandrel 36 is moved to its telescopingly extended position. It is noted that unless there is some weight set on the circulation valve 16, the operating mandrel 36 will normally be in its telescopingly extended position due to hydraulic pressure within the annulus 22 acting upon the shoulder 150 of upper adapter 42 and the upper end 40 of the latch housing 80. Then, the annulus 22 is pressured up to the second predetermined level thus shearing the shear pins 102 and moving the power mandrel 52 upwards until the power mandrel 52 is locked to the operating mandrel 36 by a locking means 72. Thus, the valve sleeve 48 will be moved upward to its fully open position as shown in FIG. 3C–3D in one continuous, very rapid motion.

If, however, the operating mandrel 36 happens to be in a position wherein it is somewhat telescopingly collapsed relative to housing 26, the circulation valve 16 will still operate in a satisfactory function. Upon pressurizing the annulus 22 to the second predetermined level, the shear pins 102 shear and the power mandrel 52 moves upward until the dog means 76 is aligned with the groove 74 and locked therein to lock the operating mandrel 36 and the power mandrel 52 together. The extent of this initial upward movement of the power mandrel 52 will depend upon the initial position of the operating mandrel 36.

Then, once the operating mandrel 36 and the power mandrel 52 are locked together, the circulation valve may be moved to its fully open position by picking up weight therefrom thereby pulling the operating mandrel 36, power mandrel 52 and valve sleeve 48 upward relative to the housing 26.

The circulation valve 16 may also be used as an automatic fill-up valve for filling the interior of the test string 12 as it is lowered into the well 14. This is accomplished by removing the shear pin assembly 64 and locking the operating mandrel 36 and power mandrel 52 together with locking means 72, before the valve 16 is attached to the test string 12.

Thus, it is seen that the apparatus and methods of the present invention readily achieve the ends and advantages mentioned as well as those inherent therein. While numerous preferred arrangements of parts and steps have been illustrated for the purposes of the present disclosure, numerous changes in the arrangement and construction of parts and steps may be made by those skilled in the art, which changes are encompassed within the scope and spirit of the present invention as defined by the appended claims.

What is claimed is:

1. A circulation valve, comprising:

a cylindrical housing having a central flow passage disposed therethrough, having a power port disposed through a wall thereof, and having a circulating port disposed through said wall below said power port;

an operating mandrel means, including an operating mandrel having a lower end telescopingly received in an upper end of said housing, and including an upper adapter attached to an upper end of said operating mandrel for connection of said circulation valve to a pipe string;

a valve sleeve slidably received in said housing and movable between an initial position blocking said valve port and an open position wherein said valve port is communicated with said central flow passage;

power mandrel means, including a power mandrel having a lower end attached to said valve sleeve and having an upper end with said lower end of said operating mandrel received therein, and having a power piston disposed on said power mandrel and sealingly received by an inner cylindrical surface of said housing, said power piston being above said power port and communicated therewith;

retaining means, operably associated with said power mandrel, said valve sleeve and said housing, for initially retaining said power mandrel in a lowermost position relative to said housing thereby retaining said valve sleeve in its said initial position until a pressure differential across said power piston exceeds a predetermined value;

locking means, operably associated with said operating mandrel and said power mandrel, for locking said operating mandrel to said power mandrel after said power mandrel moves said valve sleeve from its initial position; and wherein said operating mandrel means is further characterized as a means for reclosing said circulation port when weight is set down on said circulation valve by said pipe string and for reopening said circulation port when weight is picked up from said circulation valve by said pipe string.

2. The circulation valve of claim 1, wherein said locking means includes:

an annular groove disposed in a cylindrical outer surface of said operating mandrel;

dog means, carried by said power mandrel; and resilient biasing means for urging said dog means into said annular groove to retain said dog means therein and thereby lock said power mandrel to said operating mandrel.

3. The circulation valve of claim 2, wherein:

a longitudinal locking distance between said annular groove and said dog means when said operating mandrel is in a telescopingly extended position relative to said housing and said power mandrel is still retained in its said lowermost position relative to said housing, is greater than a longitudinal travel distance between said telescopingly extended position of said operating mandrel and a telescopingly collapsed position of said operating mandrel, so that said locking means is prevented from locking said operating mandrel and power mandrel together until after said power mandrel moves said valve sleeve upward from its initial position.

4. The circulation valve of claim 1, wherein said housing includes:

a latch housing having said operating mandrel received therein;

a differential housing having an upper end threadedly connected to a lower end of said latch housing, said differential housing including said inner cylindrical surface within which said power piston is sealingly received, and said differential housing having said power port disposed through a wall thereof;

an intermediate adapter having an upper end threadedly connected to a lower end of said differential housing; and a lower adapter having an upper end threadedly connected to a lower end of said intermediate adapter, and having said circulation port disposed through a wall thereof.

5. The circulation valve of claim 4, wherein:

said retaining means includes a pair of concentric sleeves connected together by a plurality of radially oriented shear pins arranged to be sheared upon relative longitudinal movement between said concentric sleeves;

a lower end of an innermost one of said concentric sleeves abuts an upper end of said valve sleeve; and an upper end of an outermost one of said concentric sleeves abuts a downward facing shoulder of said intermediate adapter.

6. The circulation valve of claim 4, wherein said operating mandrel includes:

an upper operating mandrel portion attached to said upper adapter and including radially outward extending longitudinal spline means engaging a radially inward extending longitudinal spline means of said latch housing; and a lower operating mandrel portion having an upper end threadedly connected to a lower end of said upper operating mandrel portion.

7. The circulation valve of claim 4, wherein said power mandrel means includes:

an upper power mandrel portion having said power piston integrally formed on a lower end thereof and having said lower end of said operating mandrel received in an upper end thereof; and a lower power mandrel portion having an upper end threadedly connected to said lower end of said upper power mandrel portion, and having a lower end threadedly connected to said valve sleeve, said lower power mandrel portion including a radially outward extending longitudinal spline means engaging a radially inward extending longitudinal spline means of said intermediate adapter.

8. The circulation valve of claim 4, wherein said valve sleeve includes:

an upper valve sleeve portion having an upper end threadedly connected to said lower end of said power mandrel means and having an annular upper valve seal means disposed in a radially outer surface thereof and sealingly engaging a bore of said lower adapter above said circulation port;

a lower valve sleeve portion having an upper end threadedly connected to a lower end of said upper valve sleeve portion, and having an annular lower valve seal means trapped between downward and upward facing shoulders of said upper and lower valve sleeve portions, respectively, said lower valve seal means sealingly engaging said bore of said lower adapter below said circulation port when said valve sleeve is in a closed position.

9. A method of flow testing a well, said method comprising the steps of:

(a) providing in a test string, a circulation valve, a tester valve below said circulation valve, and a packer means below said tester valve, said tester valve and said circulation valve each initially being in a closed position;

(b) lowering said test string into said well to a desired depth;

(c) setting said packer to seal an annulus between said test string and said well;

(d) pressurizing said annulus to a first predetermined level to thereby open said tester valve and allow a formation fluid from a subsurface formation below said packer means to flow upward through an interior of said test string;

(e) flow testing said subsurface formation;

(f) pressurizing said annulus to a second predetermined level above said first predetermined level, thereby moving a differential area piston means of said circulation valve and opening said circulation valve to communicate said interior of said test string with said annulus above said packer means, thus decreasing a pressure differential between said annulus and said interior of said test string and causing said tester valve to close;

(g) circulating said formation fluid upward out of said test string by pumping drilling fluid down said annulus, through said circulation valve and up said interior of said test string; and (h) setting down weight on said circulation valve with said test string to thereby telescopingly collapse two telescopingly engaged tubular members of said circulation valve, and thereby closing said circulation valve.

10. The method of claim 9, being further characterized as a method for also subsequently treating said well, said method further comprising the steps of:

after step (h) and while maintaining said circulation valve closed, repressurizing said annulus to said first predetermined level to thereby reopen said tester valve; and pumping a treating fluid down said interior of said test string and into said subsurface formation.

11. The method of claim 9, further comprising the steps of:

prior to step (f), picking up weight from said circulation valve to move an operating mandrel of said circulation valve to a telescopingly extended position relative to a housing of said circulation valve; and as part of step (f), locking a power mandrel means of said circulation valve to said operating mandrel of said circulation valve so that subsequent closing and opening of said circulation valve can be accomplished by setting down weight on and picking up weight from said circulation valve.

12. The method of claim 9, wherein step (f) includes the steps of:

locking a power mandrel means of said circulation valve to an operating mandrel of said circulation valve when said differential area piston means is moved; and picking up weight from said circulation valve to move said operating mandrel to a telescopingly extended position relative to said housing and thereby moving said circulation valve to a completely open position.

* * * * *